US006912866B2

(12) United States Patent
Seo et al.

(10) Patent No.: US 6,912,866 B2
(45) Date of Patent: Jul. 5, 2005

(54) ELASTIC MEMBER FOR VIBRATION ABSORPTION, AND VIBRATION ABSORBING APPARATUS USING THE SAME

(75) Inventors: Sang Ho Seo, Gwangmyeong-si (KR); Dong Hoon Lee, Incheon-si (KR); Young Hoon Yun, Daegu-si (KR); Moo Youl Kim, Seoul (KR); Hyoung Keun Lim, Suwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/671,535

(22) Filed: Sep. 29, 2003

(65) Prior Publication Data

US 2004/0170508 A1 Sep. 2, 2004

(30) Foreign Application Priority Data

Feb. 28, 2003 (KR) ..... 10-2003-0012713

(51) Int. Cl.[7] ..... F25D 23/10

(52) U.S. Cl. ..... 62/295; 62/296; 181/207; 248/638; 417/363

(58) Field of Search ..... 62/295, 296; 181/205, 181/206, 207; 248/615, 638; 417/363

(56) References Cited

U.S. PATENT DOCUMENTS 2,631,330 A * 3/1953 Becker ..... 16/30
2,685,178 A * 8/1954 Eck ..... 62/295
3,785,167 A * 1/1974 Sahs ..... 62/296
4,066,058 A * 1/1978 Anderkay ..... 123/198 E
4,891,955 A * 1/1990 Klausing et al. ..... 62/295
4,953,658 A * 9/1990 Goto ..... 181/207
5,201,489 A * 4/1993 Wolf et al. ..... 248/638
5,839,295 A * 11/1998 Lehmann ..... 62/498
6,029,942 A * 2/2000 Daddis et al. ..... 248/635
6,254,068 B1 * 7/2001 Chen et al. ..... 267/136
6,543,741 B1 * 4/2003 Li et al. ..... 248/638
6,648,295 B2 * 11/2003 Herren et al. ..... 248/636
2004/0096341 A1 * 5/2004 Hung ..... 417/363

* cited by examiner

*Primary Examiner*—William E. Tapolcai
(74) *Attorney, Agent, or Firm*—Greenblum & Bernstein, P.L.C.

(57) ABSTRACT

Disclosed is a vibration absorbing apparatus for a compressor of a refrigerator. The vibration absorbing apparatus includes: an elastic member for absorbing a vibration generated during an operation of a compressor; a base pan supporting the elastic member; a stand installed in the base pan to prevent the elastic member from being bent; and a stopper installed in an upper portion of the stand to prevent the elastic member from being escaped from the base pan during a vibration of the compressor. The elastic member includes: a body having a plurality of grooves enclosing an interior surface and an exterior surface thereof, and a hollow axially passing through a central portion of the body; and a base being a lower portion of the body and being mounted on the base pan.

20 Claims, 8 Drawing Sheets

ELASTIC MEMBER FOR VIBRATION ABSORPTION, AND VIBRATION ABSORBING APPARATUS USING THE SAME

This application claims the benefit of the Korean Application No. P2003-0012713 filed on Feb. 28, 2003, which is hereby incorporated by reference.

BACKGROUND OF THE INVENTION

1. Field of the Invention

The present invention relates to an elastic member for absorbing a vibration generated from a driving device and a vibration absorbing apparatus employing the elastic member in a compressor of a refrigerator, and more particularly, to a vibration absorbing member having an improved structure for a compressor of a refrigerator which is capable of preventing the vibration generated due to the compressor from being transmitted to other elements or a whole of the refrigerator.

2. Discussion of the Related Art

Generally, a refrigerator is an apparatus for maintaining foods for a long time period in a fresh and good state. The inside of the refrigerator is always kept below a predetermined temperature by the compressor of the refrigerator.

The compressor is an apparatus for compressing refrigerant to be in a high temperature/high pressure. While the compressor operates, the vibration continues to be generated from the compressor. The generated vibration is transmitted to other elements of the refrigerator connected to the compressor without damping, so that a noisy vibration is generated from the whole of the refrigerator.

In order to prevent this phenomenon, an elastic member is installed between the compressor of the refrigerator and a base pan for supporting the compressor to attenuate a transmittance of the vibration.

Referring to FIG. 1, the compressor (C) is mounted on the vibration absorbing apparatus (M) in a machine room of the refrigerator. Further, the vibration absorbing apparatus is configured to include an elastic member and a base pan.

Here, the elastic member functions to attenuate the vibration generated while the compressor is operated. The base pan is installed on a bottom of the machine room of the refrigerator to support the elastic member.

A procedure of transmitting the vibration generated from the compressor will be described hereinafter.

First, the vibration generated during the operation of the compressor is transmitted to the elastic member through a compressor foot connecting the compressor with the elastic member. After that, the vibration is transmitted in a partially attenuated state, to the whole of the refrigerator through the base pan.

Herein, it is desirable that the elastic member allows the vibration of the compressor to be transmitted to the base pan in the most attenuated state, and the attenuated state of the vibration depends on the material and shape of the elastic member.

Therefore, the conventional vibration absorbing apparatus has a disadvantage in which the material and the shape of the elastic member are preferentially considered for improving a performance of the vibration absorbing apparatus.

SUMMARY OF THE INVENTION

Accordingly, the present invention is directed to an elastic member for vibration absorption and a vibration absorbing apparatus using the same that substantially obviate one or more problems due to limitations and disadvantages of the related art.

An object of the present invention is to provide an elastic member for vibration absorption and a vibration absorbing apparatus using the same, in which the shape of the elastic member for vibration absorption is improved to enhance a vibration-absorbing performance and thus attenuate noise and vibration.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vibration absorbing apparatus for a compressor of a refrigerator. The vibration absorbing apparatus includes: an elastic member for absorbing a vibration generated during an operation of a compressor; a base pan supporting the overlying elastic member; a stand being installed in the base pan to prevent the elastic member from being bent; and a stopper being installed in an upper portion of the stand to prevent the elastic member from being escaped from the base pan at the time of vibration of the compressor.

Herein, the elastic member includes: a body having a plurality of grooves enclosing an interior surface and an exterior surface thereof, and a hollow axially passing through a central portion of the body; and a base being a lower portion of the body and mounted on the base pan.

More particularly, the body is shaped to have a vertical section in a zigzag, and the interior and exterior grooves are shaped to have sections that grow wider as it travels from an inner side to an outer side of the grooves.

The elastic member is formed of rubber or the like. Such multi-layered step structure of the elastic member functions as a bellows, etc. for the vibration generated during an operation of the compressor, to absorb the vibration.

Further, in the case of the groove formed on the elastic member, in order to prevent opposing outer corners of the groove from interfering each other due to the vibration of the compressor, the grooves can be shaped to grow wider toward the outer corner thereof such as in a taper shape or a round shape.

The vibration absorbing apparatus for a compressor of a refrigerator can prevent most of the vibration generated from the compressor from being transmitted to a whole of the refrigerator via the base pan and the stand.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

For understanding of the present invention, a function of a compressor in a refrigerator will be first described hereinafter.

A compressor is an apparatus for compressing a low temperature/low pressure refrigerant into a high temperature/high pressure refrigerant and discharging the high temperature/high pressure refrigerant therefrom. After the discharged refrigerant is heat-radiated to an atmosphere and is changed into the low temperature/low pressure refrigerant via an expansion unit, the low temperature/low pressure refrigerant absorbs heat from an inside of the refrigerator.

Accordingly, the storeroom of the refrigerator is maintained to be in a low temperature state while keeping freshness of the foods stored in the storeroom of the refrigerator.

However, while the compressor is operated, vibration is generated from the compressor. At this time, the generated vibration is transmitted to the whole of the refrigerator through each element of the refrigerator connected to the compressor, thereby causing the noisy vibration to be generated.

Figure 1:
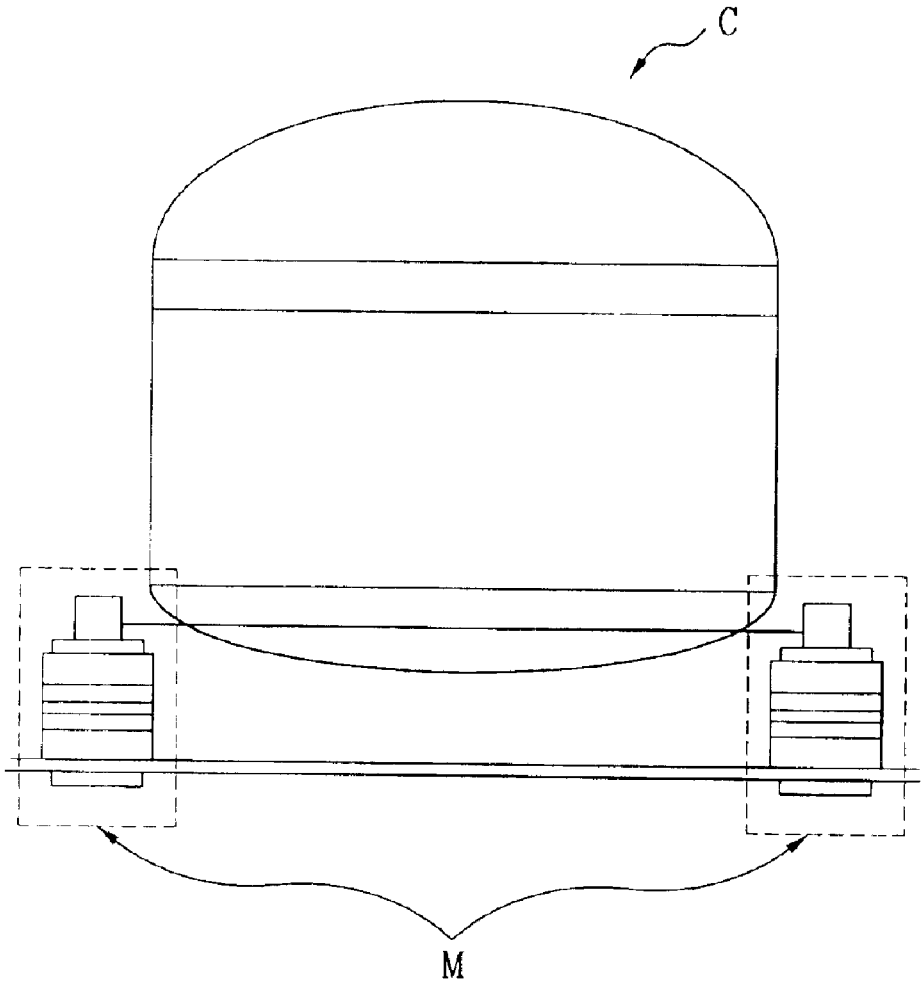
FIG. 1 is a schematic view illustrating a state in which a compressor is installed in a machine room of a refrigerator.
Figure 2:
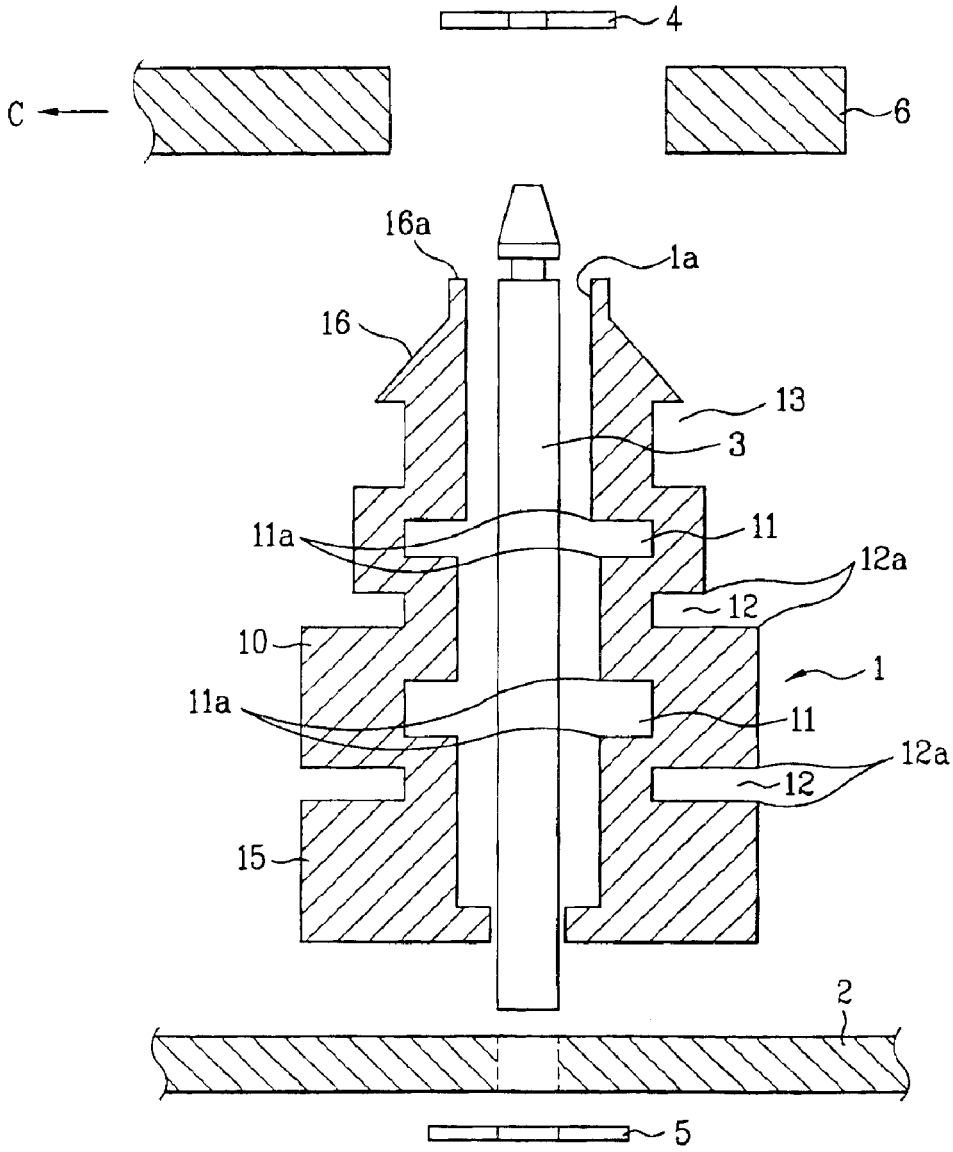
FIG. 2 is a sectional disassembly view illustrating a vibration absorbing apparatus according to a preferred embodiment of the present invention.

In order to attenuate the vibration and noise, the compressor (C) is mounted on the vibration absorbing apparatus (M) as schematically shown in FIG. 1, and a detailed construction of the vibration absorbing apparatus for the compressor according to the present invention is shown in FIG. 2.

Referring to FIG. 2, the vibration absorbing apparatus is configured to include an elastic member 1 for absorbing a vibration of a compressor, a base pan 2 for supporting the overlying elastic member 1, a stand 3 installed in the base pan 2 by a coupling unit 5 in order to pass through a hollow of the elastic member 1, and a stopper 4 installed in an upper portion of the stand 3 in order to prevent the elastic member 1 from escaping from the base pan 2.

Herein, the elastic member 1 is comprised of a body 10 for absorbing the vibration of the compressor, a base 15 provided on a lower end of the body 10 and supporting the body 10, and a stopper coupling part 16 provided on atop of the body 10. The body 10, the base 15, and the stopper coupling part 16 are integrally formed as one body.

A hollow ids formed in the elastic member 1, wherein the hollow axially passes through a central portion of the body 10, the base 15 and the stopper coupling part 16.

The elastic member 1 of the present invention is shaped to have a vertical section in a zigzag configuration. For this, a plurality of interior and exterior grooves 11 and 12 enclosing an interior surface and an exterior surface of the body 10 are formed so that the vibration-absorbing performance of the elastic member 1 is improved.

More preferably, the interior and exterior grooves 11 and 12 are shaped to have the vertical section growing wider by degrees from an inner side to an outer side thereof.

In addition, an engaging groove 13 is formed on the upper portion of the body 10 so that a compressor foot 6 is mounted on the engaging groove 13 and secured.

Figure 4:
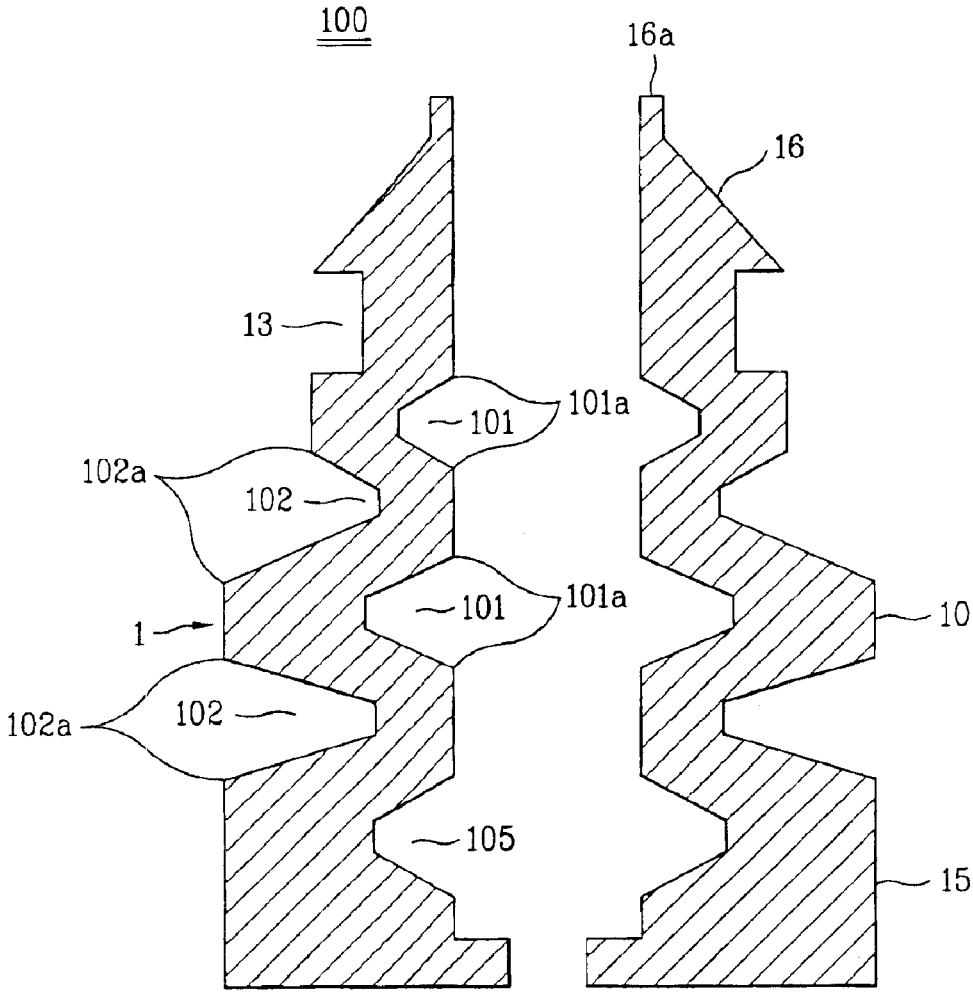
FIG. 4 is a sectional view illustrating an elastic member having a groove shaped to have a tapered section in a vibration absorbing apparatus according to a preferred embodiment of the present invention.
Figure 5:
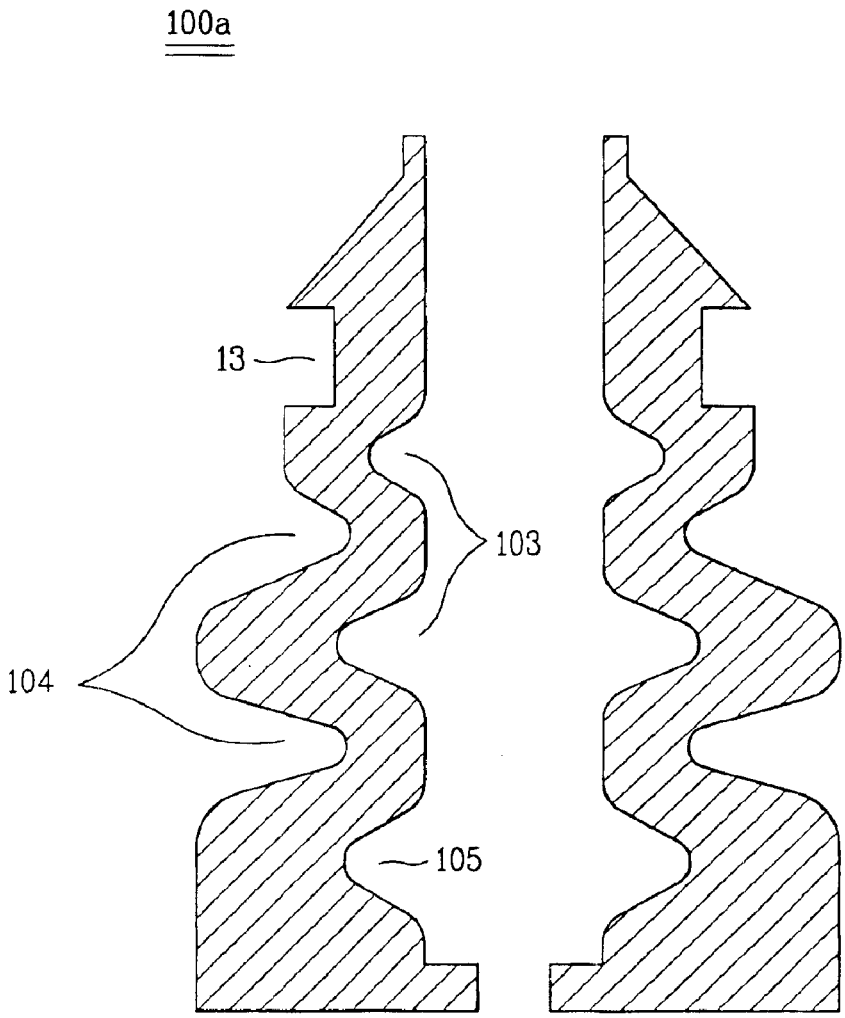
FIG. 5 is a sectional view illustrating an elastic member having a groove shaped to have a rounded section in a vibration absorbing apparatus according to a preferred embodiment of the present invention.

Embodiments for the elastic member 1 with the interior and exterior grooves shaped to have the above configuration are shown in FIGS. 4 and 5 to be described later.

A multi-layered step structure of the elastic member 1 functions as a bellows, etc. for the vibration generated during the operation of the compressor, thereby attenuating the vibration.

The stopper coupling part 16 is formed in a conical form, wherein a diameter of the stopper coupling part 16 is reduced, or grows smaller, from a lower portion to an upper portion thereof.

The stopper coupling part 16 includes a protrusion 16*a* in a ring shape formed in the top thereof and pressed by the stopper 4.

On the other hand, the base pan 2 is installed on the bottom of the machine room of the refrigerator so as to support a lower portion of the overlying elastic member 1.

Further, the stand 3 is coupled to the base pan 2 to be inserted into the hollow of the elastic member 1. An interior surface 1*a* of the hollow of the elastic member 1 and the stand 3 are installed to have a little clearance therebetween. The clearance is provided to allow the vibration of the elastic member 1 to be transmitted to the stand 3 to the minimum when the compressor (C) is operated.

Further, the stopper 4 is coupled to the upper portion of the stand 3 so as to prevent the elastic member 1 from escaping from the base pan 2. At this time, the stopper 4 is coupled to press and attach onto the protrusion 16*a* on th eupper portion of the elastic member 1.

The reason of coupling to press and attach the stopper 4 onto the protrusion 16*a* on the upper portion of the elastic member 1 is that when the compressor (C) is mounted on the elastic member 1 for operation, a space is prevented from being formed between the stopper 4 and the elastic member 1 thereby resulting in the vibration of the stopper 4.

Hereinafter, a procedure of transmitting the vibration generated from the compressor in the vibration absorbing apparatus will be described as follows.

First, the vibration generated at the time of operating the compressor (C) is transmitted to the elastic member 1 through the compressor foot 6 for connecting the compressor (C) with the elastic member 1.

Next, most of vibration of the compressor (C) is absorbed in the elastic member 1, and the rest thereof is transmitted to the base pan 2 and the stand 3.

Last, the vibration transmitted to the base pan 2 and the stand 3 is transmitted to the whole of the refrigerator.

Preferred embodiments according to the present invention will be described hereinafter, with reference to FIGS. 4 to 6. However, a description for an elementary construction and a connection relation thereof in the vibration absorbing apparatus for the compressor of the refrigerator will be omitted since they are the same as those mentioned above.

Figure 6:
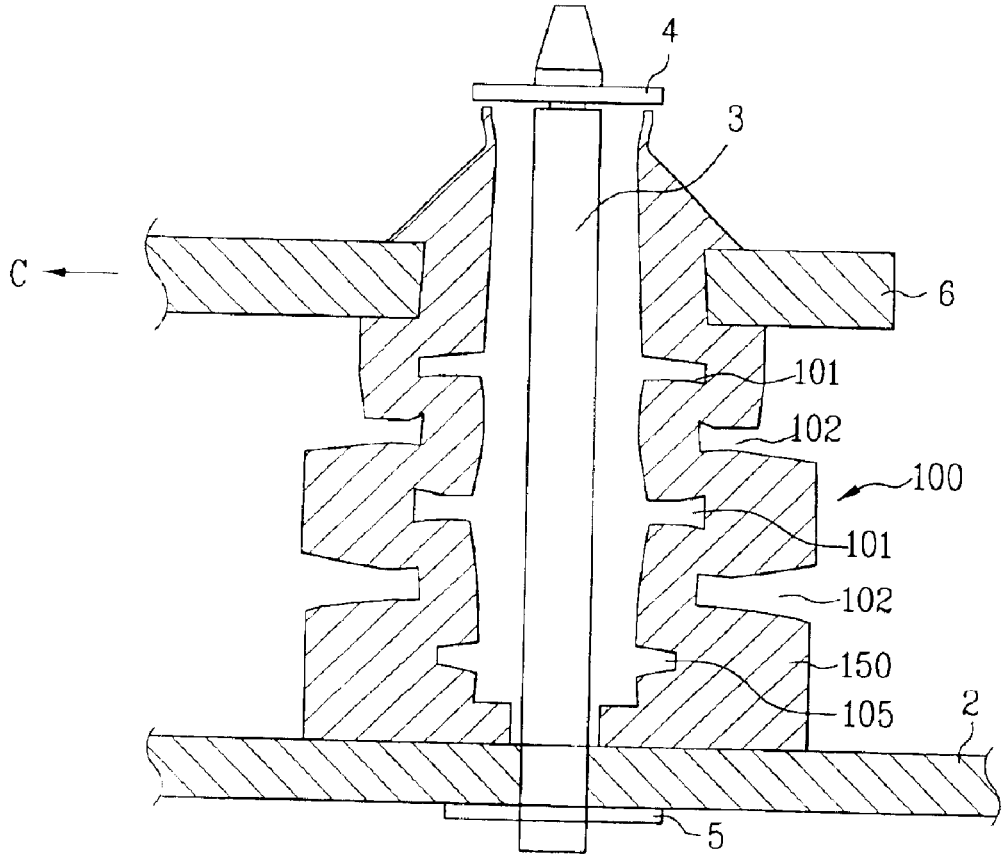
FIG. 6 is a sectional view illustrating a state in which a compressor is mounted on a vibration absorbing apparatus with an elastic member having a groove shaped to have a tapered section according to a preferred embodiment of the present invention.

FIGS. 4 and 5 are sectional views of illustrating the elastic member according to a preferred embodiment of the present invention, and FIG. 6 is a sectional view of illustrating a state in which the compressor is mounted on the vibration absorbing apparatus equipped with the elastic member having the groove shaped to have a tapered section.

FIG. 4 is a vertical sectional view of illustrating the elastic member 100 with the interior and exterior grooves 101 and 102 shaped to have the tapered sections in the vibration absorbing apparatus according to a preferred embodiment of the present invention, and FIG. 5 is vertical a sectional view of illustrating the elastic member 100*a* with the interior and exterior grooves 103 and 104 shaped to have rounded sections in the vibration absorbing apparatus according to a preferred embodiment of the present invention.

More particularly, each of the interior grooves 101, 103 is formed in a circumferential direction of the interior surface of the body 10, wherein a vertical section of each of the interior grooves 101, 103 increases, or grows wider, toward the interior surface of the body 10.

That is, each of the interior grooves 101, 103 has an upper surface and a lower surface, and a space between the upper surface and the lower surface increases, or grows wider, toward a center of the body 10.

For this, the upper surface and the lower surface of the interior grooves 101, 103 are tapered at a predetermined angle as shown in FIG. 4 or rounded as shown in FIG. 5.

And, each of the exterior grooves 102, 104 is formed in a circumferential direction of the exterior surface of the body 10, wherein a vertical section of each of the exterior grooves 102, 104 increases, or grows wider, toward the exterior surface of the body 10.

More particularly, each of the exterior grooves 102, 104 has an upper surface and a lower surface, and a space between the upper surface and the lower surface increases, or grows wider, toward an outside of the body 10.

For this, the upper surface and the lower surface of the exterior grooves 102, 104 are tapered at a predetermined angle as shown in FIG. 4 or rounded as shown in FIG. 5.

The reason of employing the tapered sections or the rounded sections in the grooves is as follows.

Figure 3:
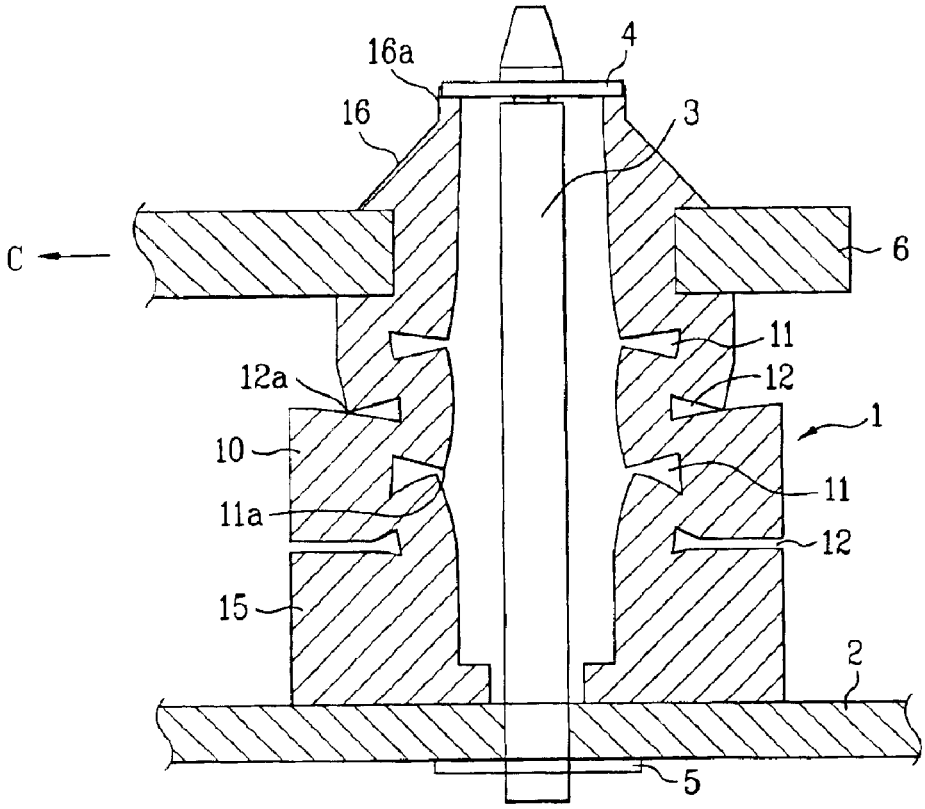
FIG. 3 is a sectional view illustrating a state in which a compressor is mounted on a vibration absorbing apparatus according to a preferred embodiment of the present invention.

That is because in case the vibration of the compressor (C) greater occurs, groove end parts 11*a* and 12*a* of the elastic member 1 can be interfered to each other as shown in FIG. 3.

Whatever grooves shaped to have the section growing wider by degrees from the inner side to the outer side thereof as well as the grooves shaped to have the tapered sections or the rounded sections as mentioned above can be employed.

Further, the base 15 of the elastic member 1 can be also formed to have a groove 105 on an interior surface thereof.

The elastic member 1 can be mainly comprised of a material such as a rubber, however is not limited to the rubber, and whatever material having an excellent elasticity can be employed in the elastic member 1.

Next, as described above, FIG. 6 is a sectional view of illustrating the state in which the compressor is mounted on the vibration absorbing apparatus equipped with the elastic member having the groove shaped to have a tapered section.

As shown in FIG. 6, even in case the vibration of the compressor occurs greater, the vibration absorbing apparatus according to the present invention can prevent the opposing outer corners 101*a* and 102*a* from being in contact with each other in each of the grooves so as to improve a performance of absorbing the vibration in the vibration absorbing apparatus.

Further, the refrigerator can be embodied as including an outer case; a cooling system having a compressor; an inner heat exchanger; a refrigerant expansion unit; and an outer heat exchanger; and a vibration absorbing apparatus having an elastic member.

Figure 7:
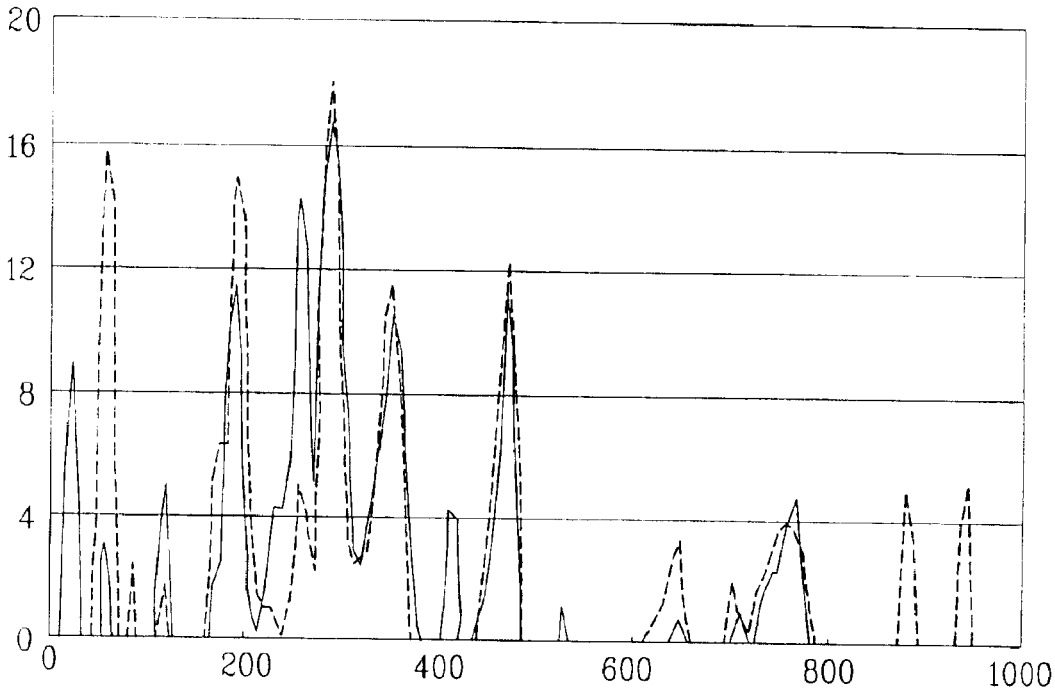
FIGS. 7 and 8 are graphs illustrating respective states in which in case a vibration absorbing apparatus has an elastic member with a groove shaped to have a tapered section, noises are attenuated from a refrigerator and a compressor according to a preferred embodiment of the present invention.
Figure 8:
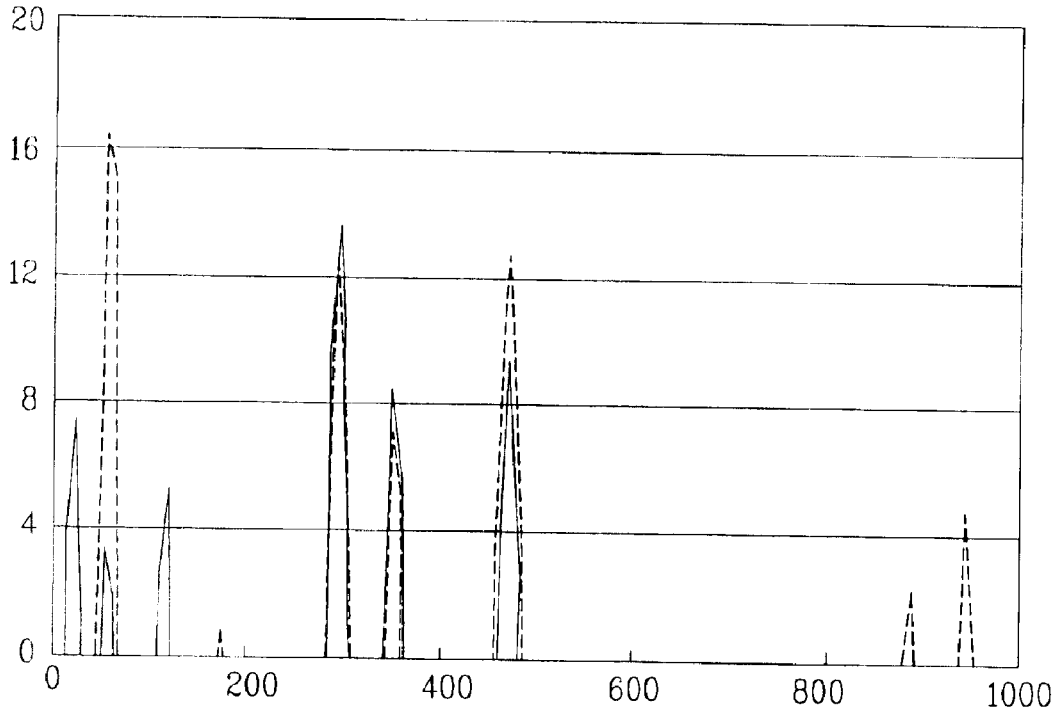

On the other hand, FIGS. 7 and 8 are graphs illustrating respectively a state in which in case the vibration absorbing apparatus is installed having the elastic member with the grooves shaped to have the tapered section, the noisy vibration of a refrigerator and a compressor are attenuated.

Referring to FIGS. 7 and 8, an X-axis indicates a frequency bandwidth (Hz), and a Y-axis indicates a noise degree (dB). A dotted line indicates a case in which in case the compressor (C) is mounted on the vibration absorbing apparatus equipped with the elastic member having the grooves shaped to have a rectangular section, the noise degree is measured. Further, a solid line indicates a case in which in case the compressor (C) is mounted on the vibration absorbing apparatus equipped with the elastic member having the grooves shaped to have the tapered section, the noise degree is measured.

As viewed in the graphs, it is understood that a modification can be made to a shaped section of the groove in the elastic member so that the noise generated can be attenuated.

Summarizing the effects of the present invention constructed as described above is as follows.

First, since the elastic member has, on the interior surface and the exterior surface thereof, the grooves shaped to have the section growing wider by degrees from the inner side to the outer side thereof, when the elastic member is shrunken, the opposing outer corners of the grooves can be prevented from interfering each other so that the vibration absorbing apparatus can improve the performance of absorbing the vibration and accordingly the vibration and the noise generated from the refrigerator can be attenuated.

Second, when the elastic member is shrunken, the opposing outer corners of the groove can be prevented from interfering each other to lengthen a life of the elastic member.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An elastic member for absorbing a vibration of a driving device, the elastic member comprising:

a body on which a compressor is mounted, the body having a plurality of grooves enclosing an interior surface and an exterior surface thereof, wherein the body is shaped to have a vertical section in a zigzag, and the interior grooves have vertical sections that grow wider toward a center of the body and the exterior grooves have vertical sections that grow wider toward an outer surface of the body;

a base provided on a lower end of the body and supporting the body, wherein the body and the base are integrally formed; and a hollow axially passing through a central portion of the body and the base.

2. The elastic member of claim 1, wherein the interior and exterior grooves are shaped to have tapered sections linearly growing wider toward the outer side thereof.

3. The elastic member of claim 1, wherein the interior and exterior grooves are shaped to have rounded sections growing wider toward the outer side thereof.

4. The elastic member of claim 1, wherein the base has a groove enclosing the interior surface thereof.

5. The elastic member of claim 1, which is formed of rubber.

6. The elastic member of claim 5, wherein the interior and exterior grooves are shaped to have tapered sections linearly growing wider toward the outer side thereof.

7. The elastic member of claim 5, wherein the interior and exterior grooves are shaped to have rounded sections growing wider toward the outer side thereof.

8. The elastic member of claim 5, wherein the base has a groove enclosing the interior surface thereof.

9. A vibration absorbing apparatus for a compressor of a refrigerator, the apparatus comprising:

an elastic member for absorbing a vibration of a compressor, the elastic member comprising:

a body on which a compressor is mounted, the body having a plurality of grooves enclosing an interior surface and an exterior surface thereof, wherein the body is shaped to have a vertical section in a zigzag, and the interior grooves have vertical sections that grow wider toward a center of the body and the exterior grooves have vertical sections that grow wider toward an outer surface of the body, a base provided on a lower end of the body and supporting the body, a stopper coupling part provided on a top of the body, wherein the body, the base and the stopper coupling part are integrally formed, and a hollow axially passing through a central portion of the body, the base, and the stopper coupling part;

a base pan supporting the elastic member;

a stand coupled to the base pan and penetrating the hollow of the elastic member; and a stopper installed in an upper portion of the stand and pressing the top of the stopper coupling part to prevent the elastic member from being escaped from the base pan.

10. The vibration absorbing apparatus of claim 9, wherein the interior and exterior grooves are shaped to have tapered sections linearly growing wider toward the outer side thereof.

11. The vibration absorbing apparatus of claim 9, wherein the interior and exterior grooves are shaped to have rounded sections growing wider toward the outer side thereof.

12. The vibration absorbing apparatus of claim 9, wherein the elastic member has a groove enclosing the interior surface of the base.

13. The vibration absorbing apparatus of claim 9, wherein the elastic member is formed of rubber.

14. The vibration absorbing apparatus of claim 13, wherein the interior and exterior grooves are shaped to have tapered sections linearly growing wider toward the outer side thereof.

15. The vibration absorbing apparatus of claim 13, wherein the interior and exterior grooves are shaped to have rounded sections growing wider toward the outer side thereof.

16. The vibration absorbing apparatus of claim 13, wherein the elastic member has a groove enclosing the interior surface of the base.

17. A refrigerator comprising:

an outer case;

a cooling system having a compressor, an inner heat exchanger, a refrigerant expansion unit, and an outer heat exchanger; and a vibration absorbing apparatus comprising;

an elastic member for absorbing a vibration of the compressor, the elastic member comprising;

a body on which a compressor is mounted, the body having a plurality of grooves enclosing an interior surface and an exterior surface thereof, wherein the body is shaped to have a vertical section in a zigzag, and the interior grooves have vertical sections that grow wider toward a center of the body and the exterior grooves have vertical sections that grow wider toward an outer surface of the body, a base provided on a lower end of the body and supporting the body, a stopper coupling part provided on a top of the body, wherein the body, the base and the stopper coupling part are integrally formed, and a hollow axially passing through a central portion of the body, the base, and the stopper coupling part;

a base pan supporting the elastic member, a stand coupled to the base pan and penetrating the hollow of the elastic member, and a stopper installed in an upper portion of the stand and pressing the top of the stopper coupling part to prevent the elastic member from being escaped from the base pan.

18. The refrigerator of claim 17, wherein the elastic member is formed of rubber.

19. The refrigerator of claim 18, wherein the interior and exterior grooves are shaped to have tapered sections linearly growing wider toward the outer side thereof.

20. The refrigerator of claim 19, wherein the elastic member has a groove enclosing the interior surface of the base.

* * * * *